US012372103B2

(12) United States Patent
Reilly et al.

(10) Patent No.: US 12,372,103 B2
(45) Date of Patent: Jul. 29, 2025

(54) FAN ASSEMBLY WITH A REMOVABLE FILTER ASSEMBLY

(71) Applicant: Dyson Technology Limited, Wiltshire (GB)

(72) Inventors: Philip Tennison Reilly, Gloucester (GB); Ben Thomas Edmonds, Swindon (GB); James Gregory Forrest, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 18/572,409

(22) PCT Filed: May 25, 2022

(86) PCT No.: PCT/GB2022/051318

§ 371 (c)(1),
(2) Date: Dec. 20, 2023

(87) PCT Pub. No.: WO2022/269224

PCT Pub. Date: Dec. 29, 2022

(65) Prior Publication Data

US 2025/0129798 A1 Apr. 24, 2025

(30) Foreign Application Priority Data

Jun. 22, 2021 (GB) ..... 2108930

(51) Int. Cl.
*F04D 29/70* (2006.01)
*F04D 25/08* (2006.01)
*F04D 29/62* (2006.01)

(52) U.S. Cl.
CPC ..... *F04D 29/703* (2013.01); *F04D 25/08* (2013.01); *F04D 29/62* (2013.01)

(58) Field of Classification Search
CPC ..... F04D 29/703; F04D 25/08; F04D 29/62; F04D 29/441
See application file for complete search history.

(56) References Cited

U.S. PATENT DOCUMENTS 3,001,606 A 9/1961 Bierwirth et al.
4,631,077 A * 12/1986 Spicer ..... B01D 46/2411 55/DIG. 13

(Continued)

FOREIGN PATENT DOCUMENTS

CN 109737076 * 5/2019
CN 109737076 A 5/2019

(Continued)

OTHER PUBLICATIONS

International Search Report and Written Opinion received for PCT Patent Application No. PCT/GB2022/051318, mailed on Sep. 2, 2022, 10 pages.

(Continued)

*Primary Examiner* — Aaron R Eastman
(74) *Attorney, Agent, or Firm* — Tucker Ellis LLP; Michael G. Craig

(57) ABSTRACT

A fan assembly, including a fan body including first and second retention assemblies and an inlet surface defining an air inlet. A motor-driven impeller contained within the fan body generates an airflow. A filter assembly attached to the fan body includes one or more flexible filter media, a first engagement element positioned at first edge of the filter media, and a second engagement element positioned at a second, opposite edge of the filter media. The filter assembly is furlable, and the first and second engagement elements releasably engage with the respective first and second retention assemblies of the fan body to retain the filter assembly tautly over the inlet surface in an at least partially unfurled state, such that, in use, airflow drawn through the air inlet by (Continued)

the motor-driven impeller is drawn through the filter media. The fan body is cylindrical in shape and the filter assembly wraps around substantially all the fan body.

19 Claims, 9 Drawing Sheets

(56) References Cited

U.S. PATENT DOCUMENTS

| | | | | |
|---|---|---|---|---|
| 4,758,460 | A * | 7/1988 | Spicer | B01D 39/14 427/244 |
| 5,641,343 | A * | 6/1997 | Frey | B01D 46/521 55/330 |
| 5,837,020 | A | 11/1998 | Cartellone | |
| 5,893,939 | A | 4/1999 | Rakocy et al. | |
| 2010/0154368 | A1 | 6/2010 | Kopec et al. | |
| 2010/0162673 | A1 | 7/2010 | Grosche et al. | |
| 2012/0312320 | A1 | 12/2012 | Humphreys et al. | |
| 2015/0231542 | A1 | 8/2015 | Wennerström et al. | |
| 2015/0231543 | A1 | 8/2015 | Wennerström et al. | |
| 2015/0273381 | A1 | 10/2015 | Stoner, Jr. et al. | |
| 2015/0308440 | A1 * | 10/2015 | Yang | F04D 29/626 416/244 R |
| 2018/0036665 | A1 | 2/2018 | Fritzsching et al. | |
| 2018/0050296 | A1 | 2/2018 | Fritzsching et al. | |
| 2020/0360848 | A1 | 11/2020 | Louison et al. | |

FOREIGN PATENT DOCUMENTS

| | | | |
|---|---|---|---|
| CN | 110541845 | A | 12/2019 |
| DE | 20108544 | U1 | 10/2002 |
| GB | 2568937 | A | 6/2019 |
| WO | 2019/140045 | A1 | 7/2019 |

OTHER PUBLICATIONS

Search Report received for GB Application No. 2108930.5, mailed on Nov. 26, 2021, 1 page.

* cited by examiner

FAN ASSEMBLY WITH A REMOVABLE FILTER ASSEMBLY

CROSS-REFERENCE TO PRIOR APPLICATIONS

This application is a § 371 National Stage Application of PCT International Application No. PCT/GB2022/051318 filed May 25, 2022, which claims the priority of United Kingdom Application No. 2108930.5, filed Jun. 22, 2021, each of which are herein incorporated by reference in their entirety.

FIELD OF THE INVENTION

The present invention relates to a fan assembly.

BACKGROUND OF THE INVENTION

Some domestic fans employ the use of one or more filters to filter and/or purify airflow before it is emitted from the fan. These filters may need replacing by a user of the fan during the lifetime of the fan.

SUMMARY OF THE INVENTION

According to a first aspect of the present invention there is provided a fan assembly comprising a fan body comprising first and second retention assemblies and an inlet surface defining an air inlet, a motor-driven impeller contained within the fan body and arranged to generate an airflow, and a filter assembly attached to the fan body. The filter assembly comprises one or more flexible filter media, a first engagement element positioned at first edge of the filter media, and a second engagement element positioned at a second, opposite edge of the filter media. The filter assembly is furlable, and the first and second engagement elements releasably engage with the respective first and second retention assemblies of the fan body to retain the filter assembly tautly over the inlet surface in an at least partially unfurled state, such that, in use, airflow drawn through the air inlet by the motor-driven impeller is drawn through the filter media.

Furlable should be understood to mean that the filter assembly can be, for example, rolled/unrolled, folded/unfolded etc. by a user without permanently deforming the filter assembly. As a result, the filter assembly may be stored and transported before and after use in a different state to that in which the filter assembly is held when releasably engaged with the fan body.

The fan assembly according to the first aspect of the present invention may be advantageous in that releasably attaching a furlable filter assembly to the fan body may allow the flexible filter media to substantially conform to a shape of the fan body. This may help to prevent the filter assembly from becoming dislodged relative to the fan body during assembly or disassembly of the fan assembly. This may also help to prevent unfiltered air from passing between the filter assembly and the fan body in use, which may increase the performance of the fan assembly by helping to ensure that only air filtered by the filter media reaches the air inlet.

The fan assembly according to the first aspect of the present invention may be advantageous in that the filter assembly may be stored and transported in a different state to a state in which the filter assembly is held when the filter assembly is releaseably attached to the fan body. This may be advantageous for protecting the filter media during storage and transport. This may also help to reduce the packaged volume of the filter assembly, which may have environmental and cost benefits for storage, packaging and transport. For example, the filter assembly may be stored and transported in a furled state, and then at least partially unfurled by a user to releasably attach the filter assembly to the fan body. By way of another example, the filter assembly may be stored and transported in a unfurled or flat state and then manipulated by a user to an at least partially unfurled state to releasably attach the filter assembly to the fan body.

The fan assembly according to the first aspect of the present invention may be advantageous in that a furlable filter assembly may be easily removed from the fan assembly and washed, for example squeezed and wrung out, to remove material captured by the filter media. This may prolong the life of the filter media and thus the filter assembly, which may have environmental as well as performance benefits.

The fan assembly according to the first aspect of the present invention may be advantageous in that a furlable filter assembly allows the use of less material to releasably attach the filter media to the fan body compared to a non-furlable filter assembly, which may be more environmentally sustainable and provide a simpler assembly process.

The filter assembly may not comprise a frame for supporting the filter media. Filter assemblies typically include a frame for supporting the filter media. By providing a furlable filter assembly that is attachable to the fan body at opposite edges of the filter assembly, the frame may be omitted and the filter media may instead be tensioned and supported by the fan body. As a result, a filter assembly comprising less material, particularly less plastic material, may be employed.

The filter media may comprise a carbon filter media for purifying air before the air enters the air inlet. As a result, the filter assembly is capable of capturing and removing odours and volatile organic compounds from the air.

The filter assembly may comprise two first engagement elements positioned at opposite ends of the first edge of the filter media, and the fan body may comprise two first retention assemblies each arranged to receive a respective first engagement element. The filter assembly may comprise two second engagement elements positioned at opposite ends of the second edge of the filter media, and the fan body may comprise two second retention assemblies each arranged to receive a respective second engagement element. This may provide a more stable attachment of the filter assembly to the fan body at the respective edge of the filter media, which may reduce the need for a frame to support the filter media. This may also reduce the likelihood of the filter assembly becoming dislodged during assembly and disassembly of the fan assembly. This may also help to increase the robustness of the filter assembly in use.

The two first retention assemblies may be longitudinally aligned in relation to one another with respect to a longitudinal axis of the fan body. The two second retention assemblies may be longitudinally aligned in relation to one another with respect to the longitudinal axis of the fan body. The longitudinal axis of the fan body is defined as an axis extending from a top to a bottom of the fan body when the fan body is oriented for correct use of the fan assembly. For example, the longitudinal axis may be a central axis passing vertically through the centre of the fan body when the fan body is oriented for correct use of the fan assembly. This may ensure that respective two first or two second the retention assemblies can both be accessed by a user without a need to rotate or otherwise move the fan body, which may provide a simple way to release the filter assembly from the fan body.

The fan body may be substantially cylindrical, for example circular or oval-shaped in cross-section, and the filter assembly wraps around the fan body. Having a circular or oval-shaped cross-section, thus without any sharp vertices, may help to remove areas of high stress in the filter media when the filter assembly is wrapped around the fan body, which may prolong the life of the filter media.

The fan body may have a non-cylindrical cross-section, such as rectangular or hexagonal, and the filter assembly may cover one or more sides of the fan body. Since the filter assembly is furlable, it may be usable with a variety of shapes of fan body.

The filter assembly may extend more than 180 degrees around the fan body. This may allow the use of a single filter assembly to cover an inlet surface that extends more than 180 degrees around the fan body, which is more readily achieved with a furlable filter assembly than a non-furlable filter assembly, such as a filter assembly comprising a rigid frame.

The filter assembly may substantially surround the fan body. That is, the filter assembly may extend in the region of 360 degrees around a circumference of the fan body. This may enable the use of a single filter assembly to cover an inlet surface that extends in the region of 360 degrees around the fan body, which advantageously reduces the number of parts in the fan assembly, which may reduce manufacturing and assembly complexity. Providing an inlet surface that extends in the region of 360 degrees around the fan body may provide a more even load to the motor-driven impeller which may provide a smoother airflow to the nozzle and may reduce noise produced by the fan assembly in use.

The first and second the retention assemblies may be positioned adjacent to one another, such that the filter assembly extends around substantially all of the fan body from the first retention assembly to the second retention assembly. That is, in the at least partially unfurled state, the flexible filter media is wrapped around the fan body.

The fan body may comprise a longitudinal channel, and the first and second retention assemblies may be provided within the channel. The longitudinal channel may be substantially linear even if a remainder of an outer surface of the fan body is non-linear. For example, the fan body may have a smaller circumference at a centre of the fan body as opposed to at the ends of the fan body such that a void is formed between the longitudinal channel and the inlet surface. This may allow for provision of a 360-degree inlet surface, which may provide a more even load to the motor-driven impeller which may provide a smoother airflow emitted from the fan assembly and may reduce noise produced by the fan assembly in use.

The fan body may comprise two or more longitudinal channels extending in a direction substantially parallel to the longitudinal axis of the fan body. Where the fan body comprises two or more longitudinal channels, the filter assembly may be arranged to extend between two adjacent longitudinal channels. For example, the fan body may comprise two longitudinal channels, one channel comprising a first retention assembly for receiving the first engagement element, and the other channel comprising a second retention assembly for receiving the second engagement element. This may allow the filter assembly to wrap around a fan body of any shape.

The first and second retention assemblies may comprise respective apertures defined in the fan body, the apertures arranged to receive the respective first and second engagement elements. This may provide a smoother outer surface of the fan body, which may aid in manufacture and assembly of the fan assembly. This may also help to prevent damage to the retention assemblies since they are inaccessible to a user.

The apertures may be defined in an outer surface of the fan body and extend radially inwards, such that the engagement elements are engaged with the retention assemblies by a user pressing the engagement elements into the apertures in a radial direction. This may provide a simple way for a user to engage the engagement elements with the retention assemblies.

The apertures may be defined in an outer surface of the fan body and extend in a tangential direction to the outer surface. For example, the longitudinal channel may extend radially from the fan body and the apertures may be defined on opposite sidewalls of the longitudinal channel. This may provide a smooth interface between the channel and the filter assembly.

The retention assemblies may comprise a pair of detents arranged to releasably retain the respective engagement element between the pair of detents. This may provide a simple mechanism for attaching the filter assembly to the fan body.

The retention assemblies may be biased towards a position in which the engagement element is retained by the retention assembly. This may allow for a single-movement connection between the retention assembly and the engagement element, without the need for a separate locking motion to be performed by a user.

The fan assembly comprises a release switch actuable by a user to release at least one of the first and second engagement elements from the respective first or second retention assembly. The release switch may be actuable by a user to release all of the first and second engagement elements. The release switch may be comprised in the fan body, for example positioned on the longitudinal channel, to provide easy access to the release switch by a user.

The filter assembly may comprise first and second release tabs each secured to a respective first and second engagement element, and the first and second engagement elements are each arranged to be released from a respective retention assembly upon application of a force to the respective release tab by a user. The provision of the release tabs may provide a simple way for the user to release the filter assembly from the fan body and may negate the need for a more complex release switch. This may allow each engagement element to be released separately from the other so that the user has more control over the filter assembly as the filter assembly is removed from the fan body.

The filter assembly may comprise a first release tab for each first engagement element and a second release tab for each second engagement element. This may provide a user with more control over the release of the filter assembly from the fan body so that each engagement element is released separately from the other.

The release tabs may be formed from a flexible material, for example a textile or fabric or a natural material such as leather. The use of a flexible material may allow the release tabs to be laid flat against an outer surface of the fan body or filter assembly in use to provide a smoother outer surface. This may be beneficial for a fan assembly in which further components may be placed over the filter assembly.

The release tabs may be biased towards a tangential direction around the fan body and may be movable towards a radial direction by a user to release the respective engagement element from the retention assembly. For example, the release tabs may be creased to encourage a free end of the release tab towards the tangential direction. This may allow the release tabs to be laid flat against an outer surface of the fan body or filter assembly in use to provide a smoother outer surface. This may be beneficial for a fan assembly in which further components may be placed over the filter assembly.

The first and second engagement elements comprise a rigid moulding for receiving the respective edge of the filter media. The rigid moulding may provide a rigid interface between the filter media and the fan body, which may help to ensure the filter media is positioned correctly and may prevent unfiltered air from passing through the filter assembly to the air inlet. The rigid moulding may be formed from a plastic material for ease of manufacture and recycling. The rigid moulding may be clamped and/or adhered to the filter media to retain the filter media in the rigid moulding. The rigid moulding may be shaped to conform to a shape of the fan body to ensure a close fit between the filter assembly and the fan body.

The rigid moulding may comprise a recess for receiving a user's finger. This may aid a user to inset the engagement element into the respective retention assembly without damaging the filter media.

The rigid moulding may comprise the engagement element. The rigid mounding and the engagement element may be monolithic. This may provide a simple construction of the filter assembly.

The fan assembly may comprise at least one radial flange at an end of the fan body, and the filter assembly abuts the radial flange. The radial flange may provide a seal between the filter assembly and the air inlet to help prevent unfiltered air from passing between the filter assembly and the radial flange.

The air inlet may comprise an array of apertures formed in the inlet surface and the filter media may be arranged to cover the apertures to help prevent unfiltered air from reaching the air inlet.

The fan assembly may comprise a further filter assembly releasably attached to the fan body and arranged to cover the filter media. The further filter assembly may provide a protective covering for the filter media.

The further filter assembly may comprise a further filter, the further filter positioned upstream of the filter assembly when the fan assembly is assembled. This may provide additional airflow filtration. The further filter may be replaceable by a user separately to replacement of the filter assembly. This may be more environmentally sustainable in the event that the filter assembly and the further filter have a different life span to one another.

Optional features of aspects of the present invention may be equally applied to other aspects of the present invention, where appropriate.

DETAILED DESCRIPTION OF THE INVENTION

There will now be described a fan assembly comprising one or more filter assemblies and mechanisms for retaining and releasing the filter assemblies that provide several advantages over those of conventional fan assemblies. The term "fan assembly" as used herein refers to a fan assembly configured to generate and deliver an airflow for the purposes of thermal comfort and/or environmental or climate control. Such a fan assembly may be capable of generating one or more of a dehumidified airflow, a humidified airflow, a purified airflow, a filtered airflow, a cooled airflow, and a heated airflow.

Figure 1:
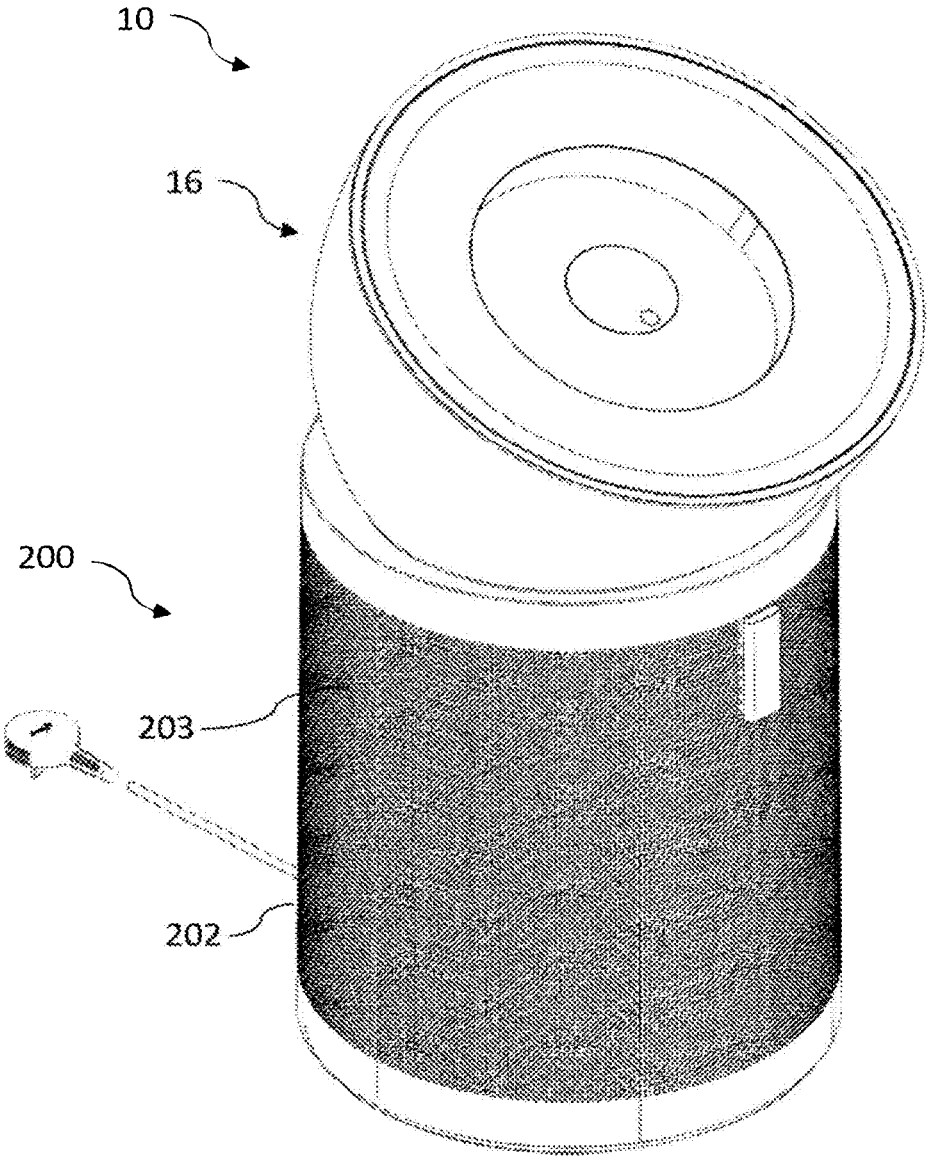
FIG. 1 is an isometric view illustrating a fan assembly according to the present invention.
Figure 2:
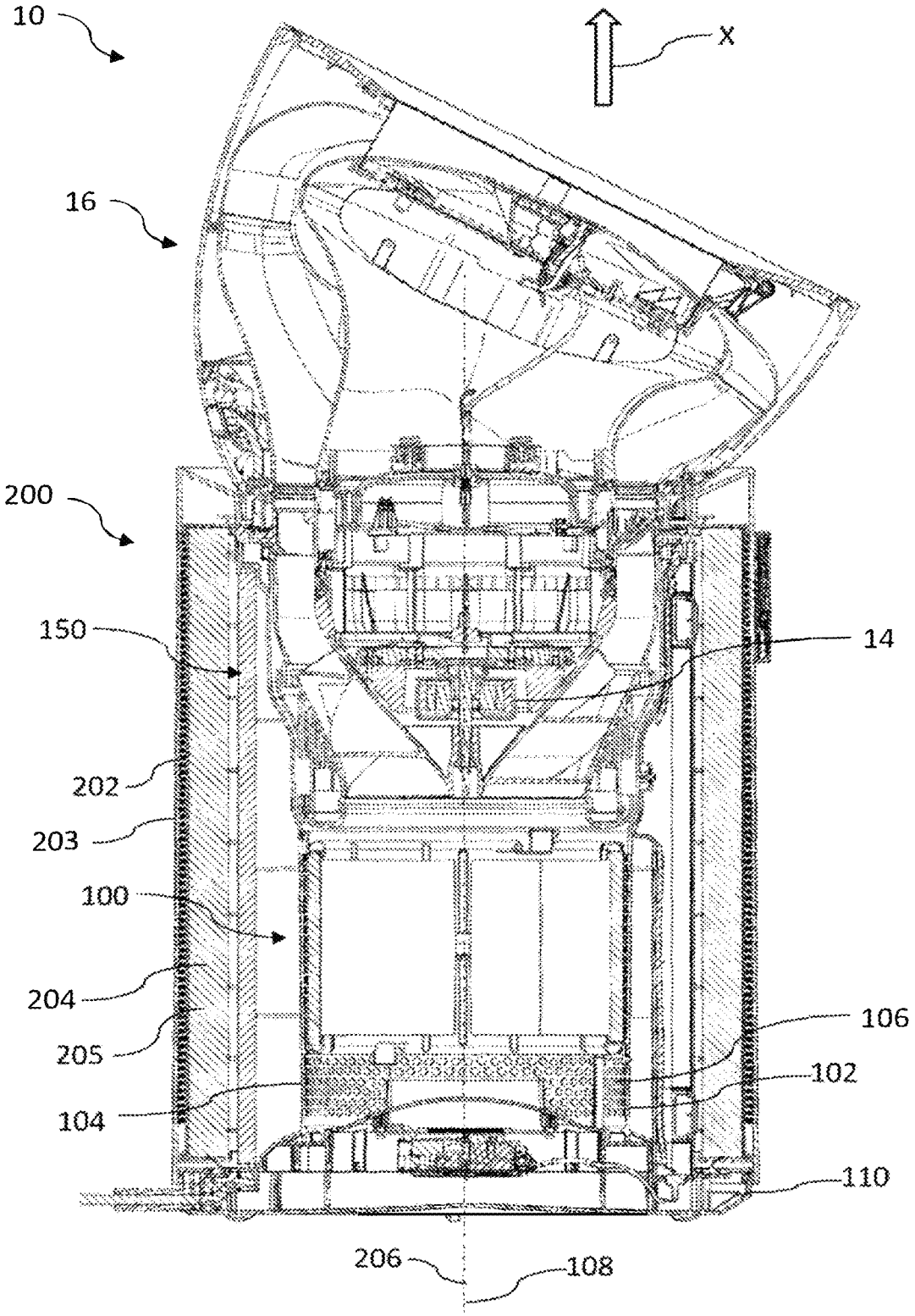
FIG. 2 is a sectional side view through the fan assembly of FIG. 1.

A fan assembly according to the present invention, generally designated 10, is shown schematically in FIG. 1 and in cross-section in FIG. 2.

The fan assembly 10 comprises a fan body 100, a motor-driven impeller 14 contained within the fan body 100 and arranged to generate an airflow, and a nozzle 16 mounted on and supported by the fan body 100. The nozzle 16 is arranged to receive the airflow from the fan body 100 and to emit the airflow from the fan assembly 10.

The fan body 100 comprises an inlet surface 102 defining an air inlet 104. In the embodiment shown in FIGS. 1 and 2, the inlet surface 102 is a curved surface extending around the cylindrical fan body 100. The air inlet 104 comprises an array of apertures 106 formed in the inlet surface 102, which in this instance surround the fan body to provide a 360-degree air inlet 104.

Figure 3:
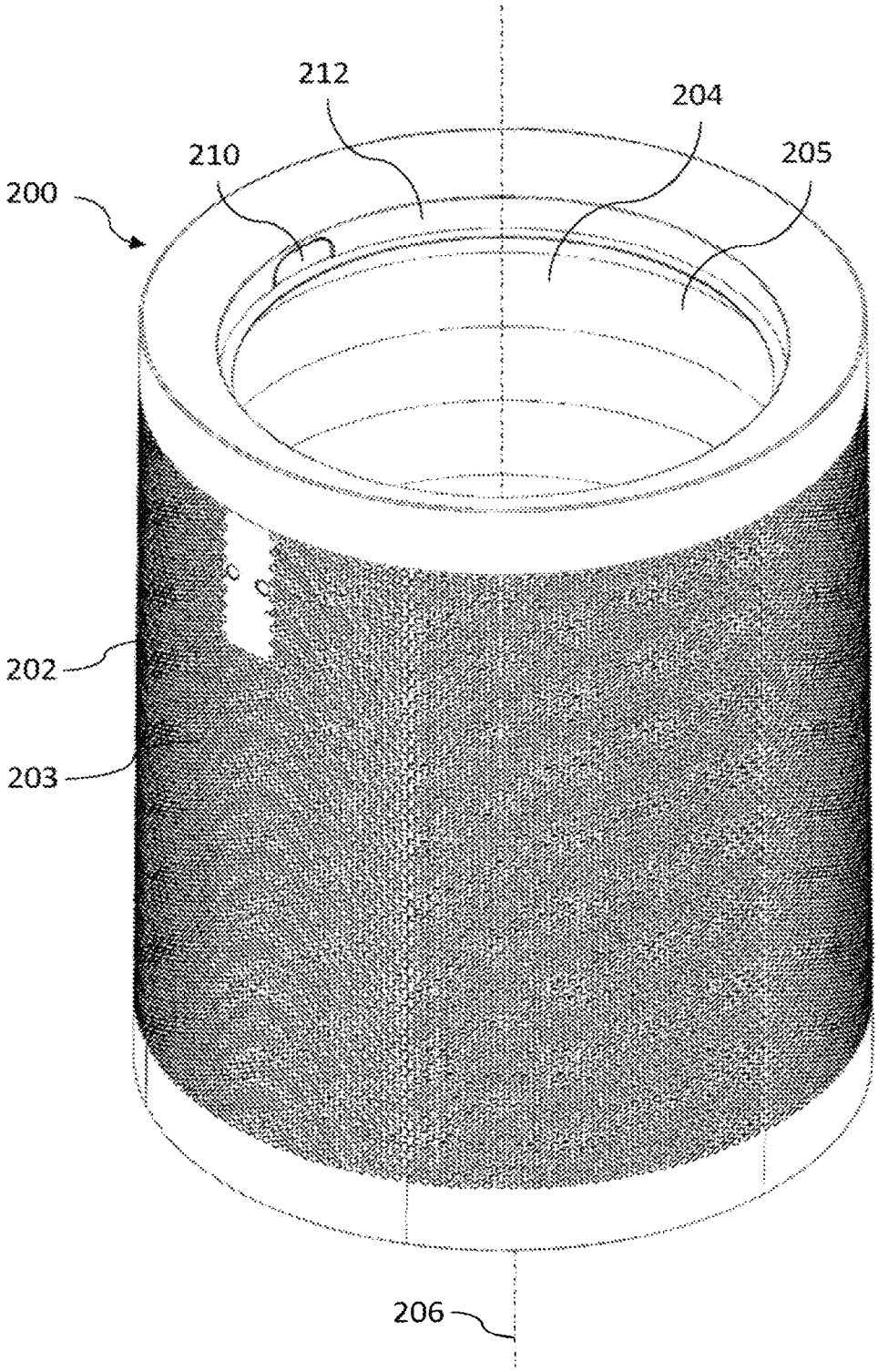
FIG. 3 is an isometric view of a filter assembly of the fan assembly of FIG. 1.

The fan assembly 10 comprises a filter assembly 200 surrounding the fan body 100 when engaged with the fan body 100. The filter assembly 200 is arranged to removably engage with the fan body 100 and to cover the inlet surface 102 when engaged with the fan body 100. FIG. 3 shows an isometric view of the filter assembly 200. The filter assembly 200 is tubular and is arranged to be concentric with the fan body 100 when engaged with the fan body 100 such that it surrounds the fan body 100 through 360 degrees. The filter assembly 200 has an inner cross-sectional shape that corresponds to an outer cross-sectional shape of the fan body 100, which in this embodiment is circular.

The filter assembly 200 is arranged to slidably engage with the fan body 100. That is, the filter assembly 200 is placed over the fan body 100 by a user and allowed to slide downwards to cover the inlet surface 102. A central axis 108 of the fan body 100 is co-axial with a longitudinal axis 206 of the filter assembly 200 when the filter assembly is engaged with the fan body 100 and the filter assembly 200 slides in a direction (denoted by arrow X in FIG. 2) parallel to the central axis 108 to engage the filter assembly 200 with the fan body 100.

The fan assembly 10 is arranged such that the when the nozzle 16 is mounted on the fan body 100, the filter assembly 200 cannot slide relative to the fan body 100 to disengage the filter assembly 200 from the fan body 100.

The filter assembly 200 comprises a filter 204 and a housing 202 for the filter 204. The filter 204 comprises a particulate filter medium 205 arranged to filter out particulates from the airflow generated by the motor-driven impeller 14 before the particulates reach the air inlet 104. The filter 204 further comprises a filter frame 216 covering the edges of the filter media 205.

The fan body 100 is provided with sealing elements (not shown), which contact surfaces of the filter assembly 200 when the filter assembly 200 is disposed on the fan body 100. The sealing elements may contact surfaces of the filter frame 216. The sealing elements help to prevent air from passing around the filter media 205 to the air inlet 104.

The housing 202 is substantially cylindrical and is arranged to cover the filter 204, which is also substantially cylindrical, such that when the filter assembly 200 is engaged with the fan body 100, the filter 204 and housing 202 surround the inlet surface 102 and the filter 204 is encased between the housing 202 and the fan body 100. The housing 202 comprises a plurality of apertures 203 to allow airflow to pass through the housing 202 to the filter 204.

Figure 4:
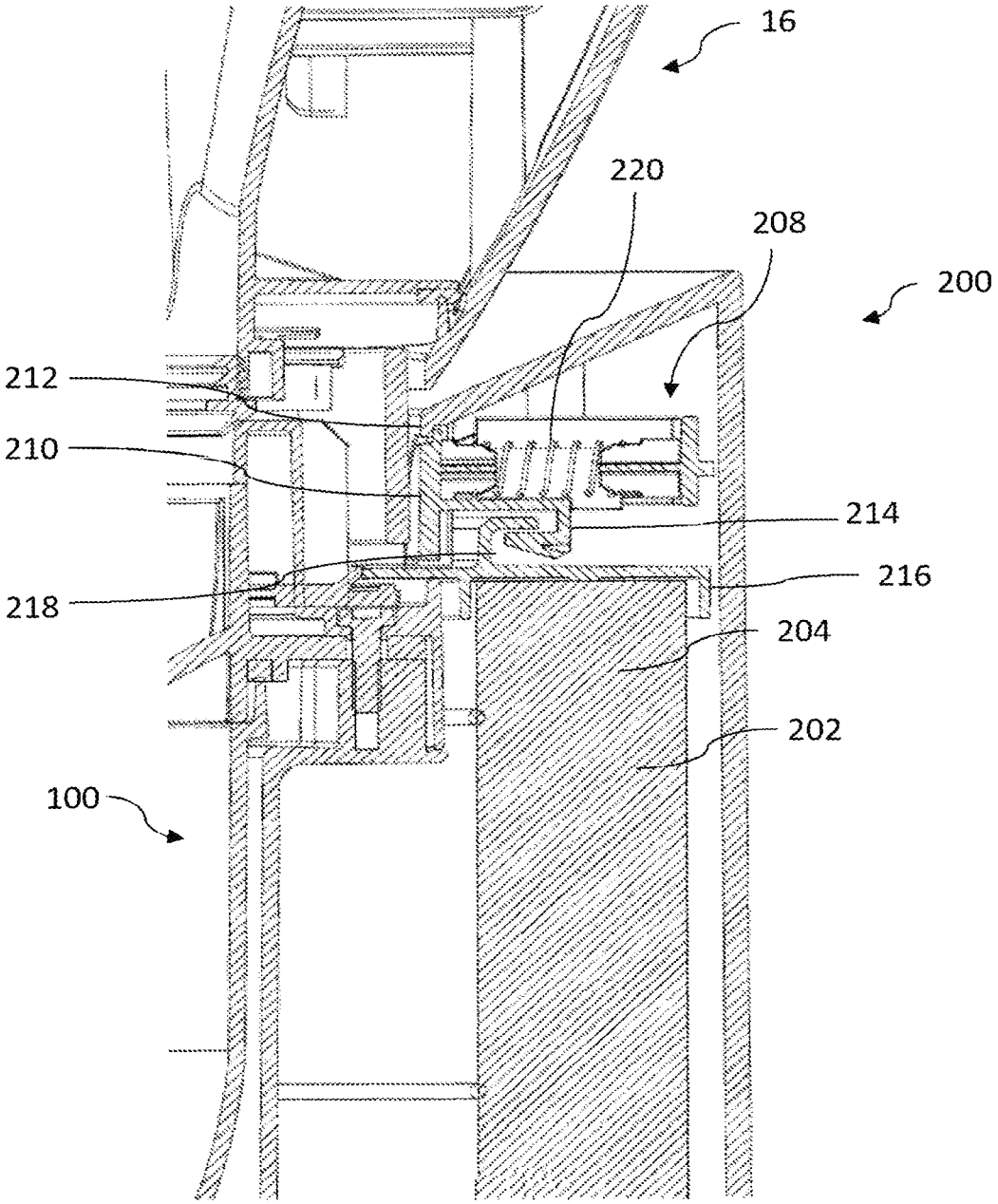
FIG. 4 is a sectional side view of a release mechanism of the fan assembly of FIG. 1.
Figure 5:
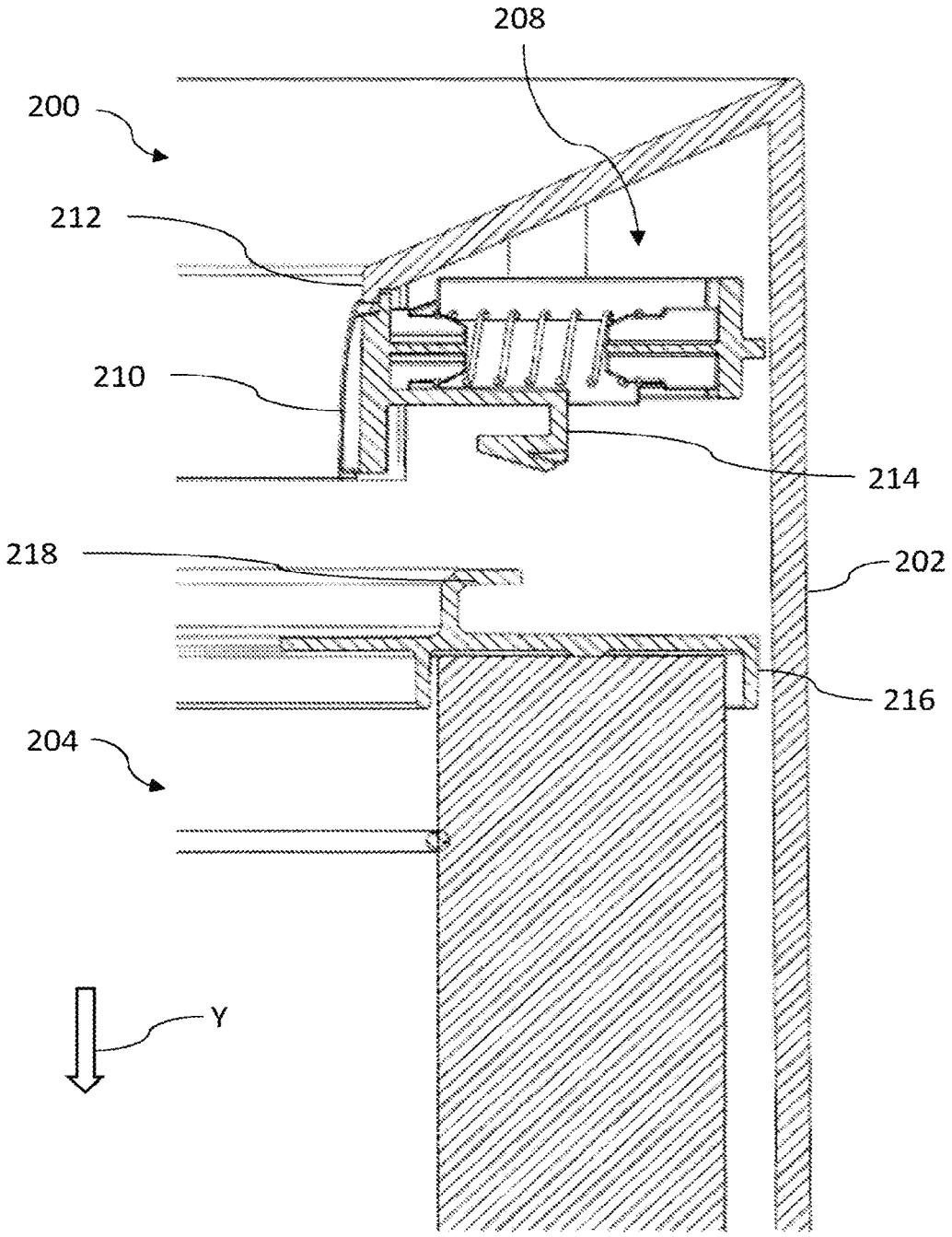
FIG. 5 is a sectional side view of the release mechanism of FIG. 4, with the filter assembly separated from the fan body and the filter separated from the housing.

During use of the fan assembly 10, the filter 204 collects particulates and the filtration performance of the filter 204 may degrade over time. The filter 204 may therefore be removed and replaced or cleaned. As best shown in FIGS. 4 and 5, the housing 202 is provided with two filter retention assemblies 208 for releasably retaining the filter 204 in the housing 202, and two user interfaces 210 for actuating the filter retention assembles 208 to release the filter 204 from the housing 202. The two user interfaces 210 are disposed at the same end of the housing 202 as each other, and at diametrically opposite sides of the housing 202. It will be understood that other embodiments may include only one filter retention assembly 208 and one user interface 210, or more than two filter retention assemblies 208 and user interfaces 210, and that the user interfaces 210 may be positioned at any suitable position on the housing 202.

The user interface 210 is a button positioned on the housing 202, such that a user does not need to touch the filter 204 to depress the button and release the filter 204 from the housing 202. The user interface 210 is inaccessible by a user when the filter assembly 200 is engaged with the fan body 100. In this embodiment, the nozzle 16 blocks the user interface 210 from view when mounted on the fan body 100 to prevent inadvertent release of the filter 204 during use of the fan assembly 10, as best shown in FIGS. 2 and 4. The user interface 210 is positioned on an inner surface 212 of the housing 202 such that the user interface 210 cannot be operated when the filter assembly 200 is engaged with the fan body 100. It will be understood that the user interface 210 could take any other suitable form for a user to actuate the filter retention assembly 208, such as a switch or handle.

The filter retention assembly 208 is movable between a locked position, as shown in FIG. 4, in which the filter 204 is retained to the housing 202, and an unlocked position, in which the filter 204 is free to slide relative to the housing 202 upon release from the filter retention assembly 208.

Figure 6:
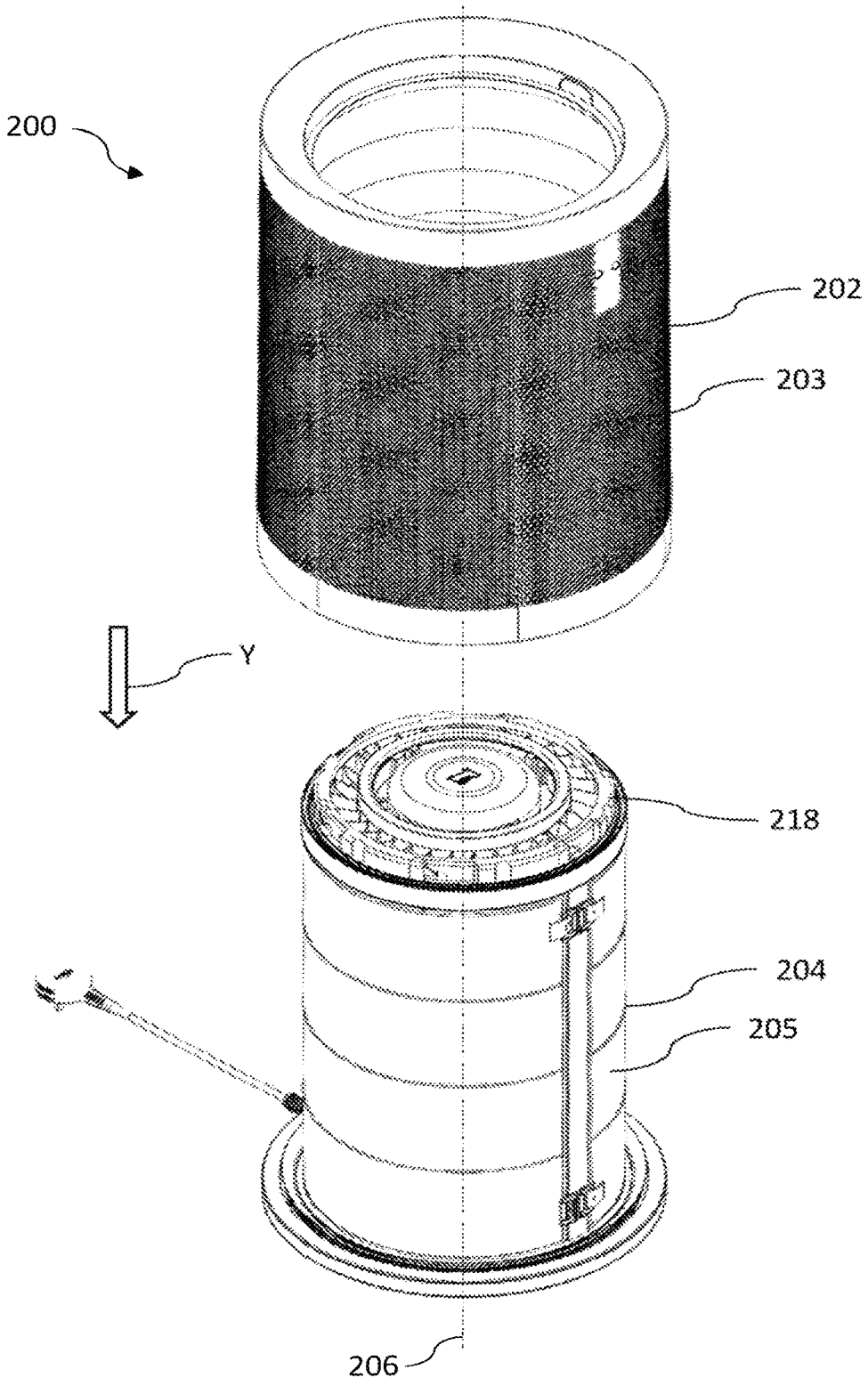
FIG. 6 is an isometric view of the filter assembly of FIG. 3 with the filter removed from the housing.

The filter retention assembly 208 comprises a catch 214 arranged to engage the filter 204 when the filter retention assembly 208 is in a locked position, as shown in FIG. 4. The catch 214 is arranged to disengage from the filter 204 upon actuation via the user interface 210, as shown in FIG. 5. The catch 214 is disposed on the housing 202. The filter frame 216 is located at an upper edge of the filter medium 205 and is provided with a rim 218 that is arranged to be engaged by the catch 214. In the embodiment shown in the Figures, the rim 218 extends around a top edge of the filter 204 to form a circle, as best shown in FIG. 6, allowing the filter 204 to be located in the housing 202 at any angle of rotation about the longitudinal axis 206. It will be understood that in other embodiments, the rim 218 may have a shorter arc length and extend only partially around the filter 204, whilst still allowing engagement between the filter frame 216 and the catch 214.

The filter retention assembly 208 is biased towards the locked position by a spring 220, to ensure automatic engagement between the catch 241 and the filter frame 216 when the filter 204 is slid into the housing 202 by a user.

Upon actuation of the filter retention assembly 208 via the user interface 210, the filter 204 is free to slide relative to the housing 202. The filter 204 slides in a direction relative to the housing 202, as shown by arrow Y in FIGS. 5 and 6, parallel to the longitudinal axis 206 of the filter assembly 200 and along a length of the filter 204. The housing 202 comprises an aperture (not shown) through which the filter 204 passes to remove the filter 204 from the housing. The aperture is positioned on an underside of the housing 202 to allow the filter 204 to slide under gravity relative to the housing 202 upon release from the filter retention assembly 208, such that the filter 204 can be released from the housing 202 without a user making contact with the filter 204. For example, a user may hold the filter assembly 200 above a bin, then press the user interface 210 to release the filter 204, which falls under gravity into the bin.

Figure 7:
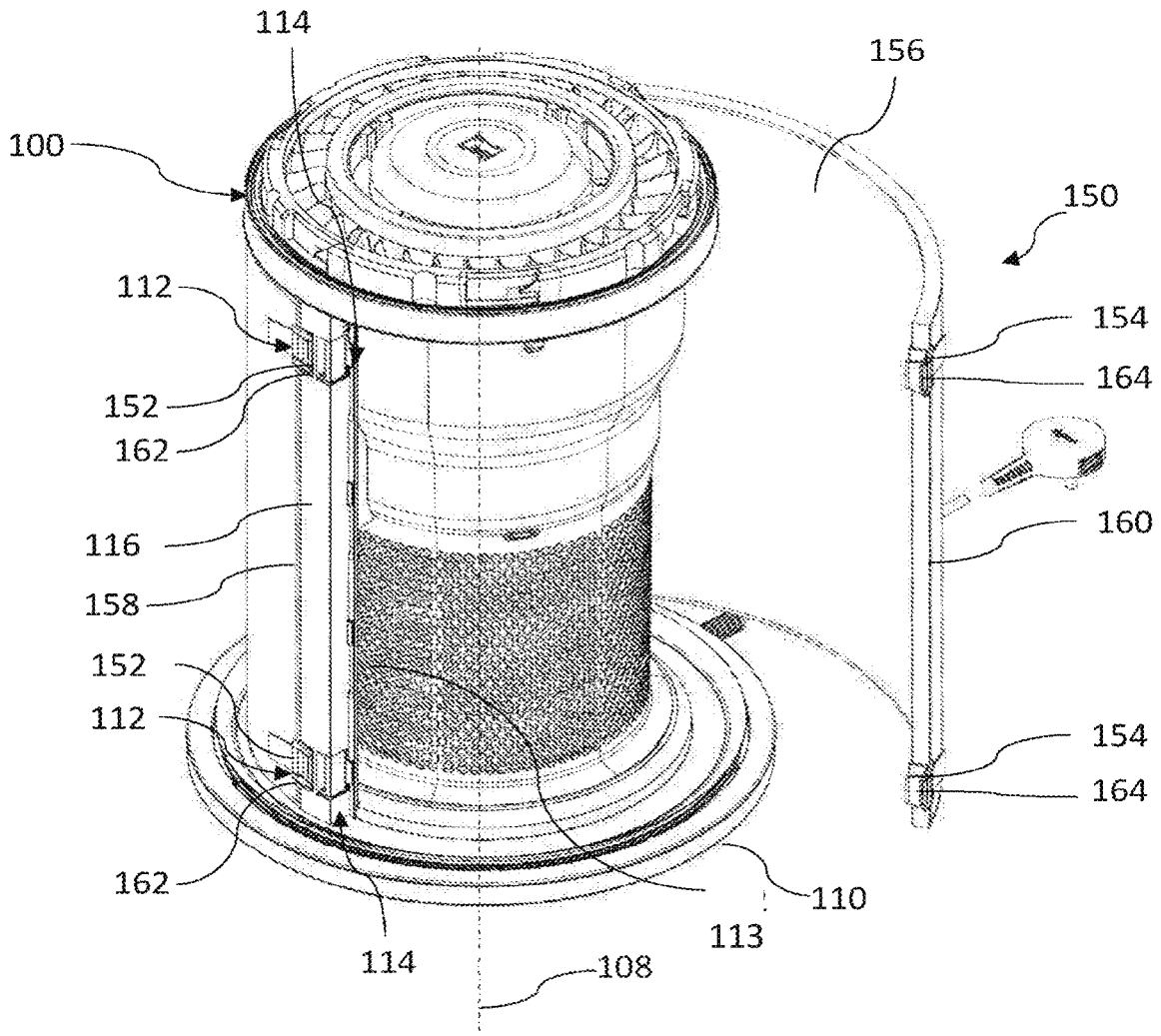
FIG. 7 is an isometric view of the fan assembly of FIG. 1 with the filter assembly removed.

The fan assembly 10 comprises a further filter assembly 150 attached to the fan body 100. The further filter assembly 150 is furlable so as to wrap around the fan body 100 to cover the inlet surface 102, as shown in FIG. 7, which shows the further filter assembly 150 having been wrapped part of the way around the fan body 100. The further filter assembly 150 substantially surrounds the fan body 100 when in place on the fan body 100 so as to cover the inlet surface 102.

The further filter assembly 150 comprises a flexible filter media 156. The filter media 156 is a carbon filter media for purifying air before the air enters the air inlet 104. The filter media 156 is arranged to cover the array of apertures 106 defined in the inlet surface 102.

The fan body 100 comprises two first retention assemblies 112 and two second retention assemblies 114, and the further filter assembly 150 comprises two first engagement elements 152 and two second engagement elements 154, each for engagement with the respective retention assemblies 112, 114. The first engagement elements 152 are positioned at opposite ends of a first edge 158 of the filter media 156 and the second engagement elements 154 are positioned at opposite ends of a second edge 160 of the filter media 156. When the retention assemblies 112, 114 and engagement elements 152, 154 are engaged, the further filter assembly 150 is retained tautly over the inlet surface 102 in a partially unfurled state such that the further filter assembly 150 is tautly wrapped over the inlet surface 102. This helps to ensure that airflow drawn through the air inlet 104 by the motor-driven impeller 14 is drawn through the filter media 156. The use of the retention assemblies 112, 114 and engagement elements 152, 154 negates the need for a more conventional frame to support the flexible filter media 156.

The two first retention assemblies 112 are longitudinally aligned in relation to one another with respect to the central axis 108 of the fan body 100. The two second retention assemblies 114 are longitudinally aligned in relation to one another with respect to the central axis 108 of the fan body 100. The fan body 100 comprises a longitudinal channel 116 extending from the top to the bottom of the fan body 100 and parallel to the central axis 108 of the fan body 100. The retention assemblies 112, 114 are provided within the longitudinal channel 116 such that the first and second the retention assemblies 112, 114 are positioned adjacent to one another and the further filter assembly 150 wraps around substantially all of the fan body 100.

The inlet surface 102 has a smaller radius than a top and bottom of the fan body 100. This creates a void 113 between the longitudinal channel 116 and the inlet surface 102, and thus between the further filter assembly 150 and the inlet surface 102. This allowing for a 360-degree air inlet 104, which provides a more even load to the motor-driven impeller 114 to improve performance of the fan assembly 10 and to reduce noise produced by the fan assembly 10 in use.

The first and second engagement elements 152, 154 each comprise a rigid moulding 162, 164 secured to a respective edge 158, 160 of the filter media 156. The rigid mouldings 162, 164 may be secured to the filter media 156 with glue. The rigid mouldings 162, 164 transfer force applied to the further filter assembly 150 by a user to the fan body 100, rather than the force transferring through the filter media 156 to the fan body 100, which could damage the filter media 156. The rigid mouldings 162, 164 and the respective engagement elements 152, 154 are each monolithic.

Figure 8:
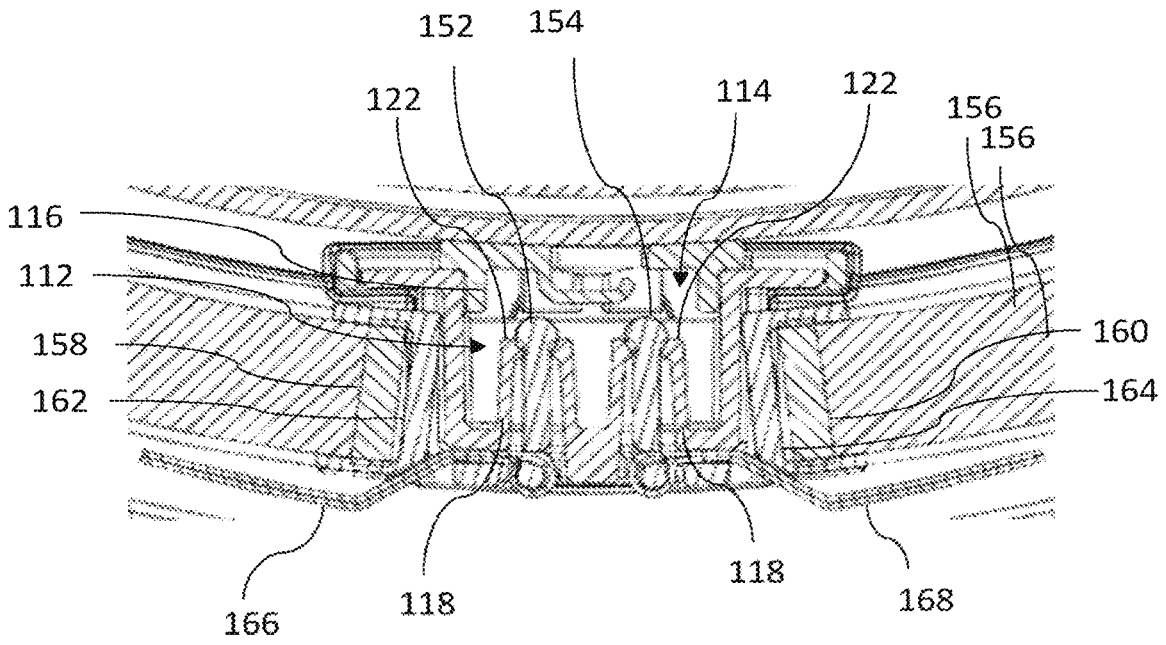
FIG. 8 is a sectional top view of a release mechanism of the fan assembly of FIG. 1.
Figure 9:
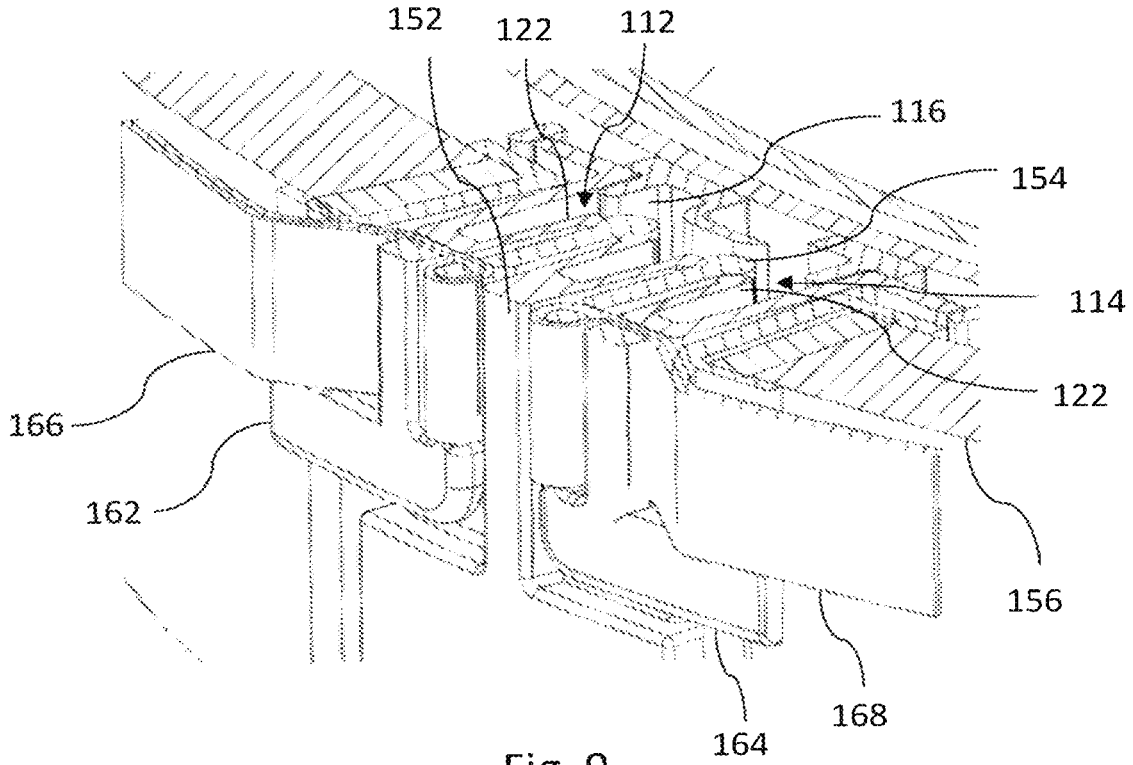
FIG. 9 is an isometric view of the release mechanism of FIG. 8.

FIGS. 8 and 9 shows the first and second retention assemblies 112, 114, and the first and second engagement elements 152, 154 in an engaged position. The first and second retention assemblies 112, 114 comprise respective apertures 118 which extend in a radial direction to receive the respective engagement elements 152, 154 in a radial direction of the fan body 100, such that the edges 158, 160 of the filter media 156 are pushed by a user in the radial direction of the fan body 100 to engage the engagement elements 152, 154 with the retention assemblies 112, 114.

The first and second retention assemblies 112, 114 each comprise a pair of detents 122 arranged to releasably retain the respective engagement element 152, 154 between the pair of detents 122 until application of a force by a user.

The further filter assembly 150 comprises first and second release tabs 166, 168 secured to respective first and second engagement elements 152, 154, as best shown in FIGS. 8 and 9. The first and second engagement elements 152, 154 are each arranged to be released from a respective retention assembly 112, 114 upon application of a force to the respective release tab 166, 168 by a user. The release tabs 166, 168 are formed from fabric and are flexible so that they can lay flat against the rigid mouldings 162, 164 when the filter assembly 200 is engaged with the fan body 100.

The filter assembly 200 is arranged to cover the further filter assembly 150 to provide two-stage airflow filtration upstream of the air inlet 104. The further filter assembly 150 and the filter 204 are independently replaceable by a user, which is particularly advantageous should the lifespans of the further filter assembly 150 and the filter 204 differ.

The fan body 100 comprises a radial flange 110 at a lower end of the fan body 100 which acts as a stop for the filter assembly 200, to ensure the filter assembly 200 is correctly positioned with respect to the inlet surface 102 when engaged with the fan body 100. That is, the filter assembly 200 abuts the radial flange 110 when engaged with the fan body 100 to prevent unfiltered airflow from reaching the air further filter assembly 150. When wrapped around the fan body 100, a lower edge of the further filter assembly 150 abuts the radial flange 110 to prevent unfiltered airflow from reaching the air inlet 104. The lower end of the fan body 100 is defined as a lower end of the fan body 100 when the fan body 100 is correctly orientated for use.

Figure 10:
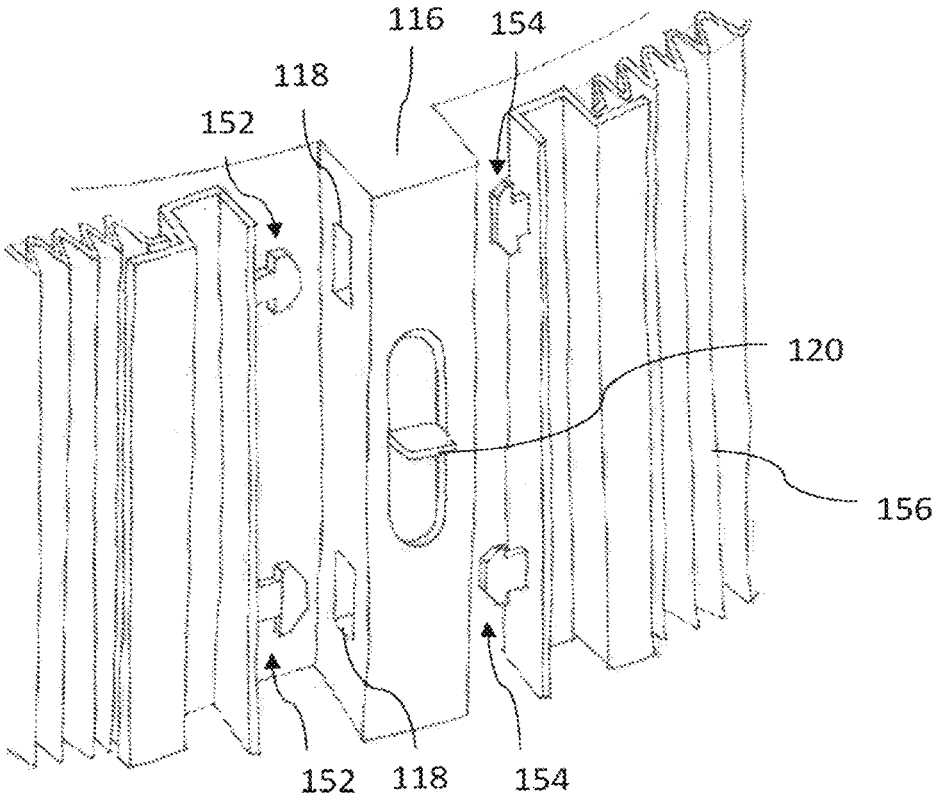
FIG. 10 is an isometric view of an alternative release mechanism according to the present invention.
Figure 11:
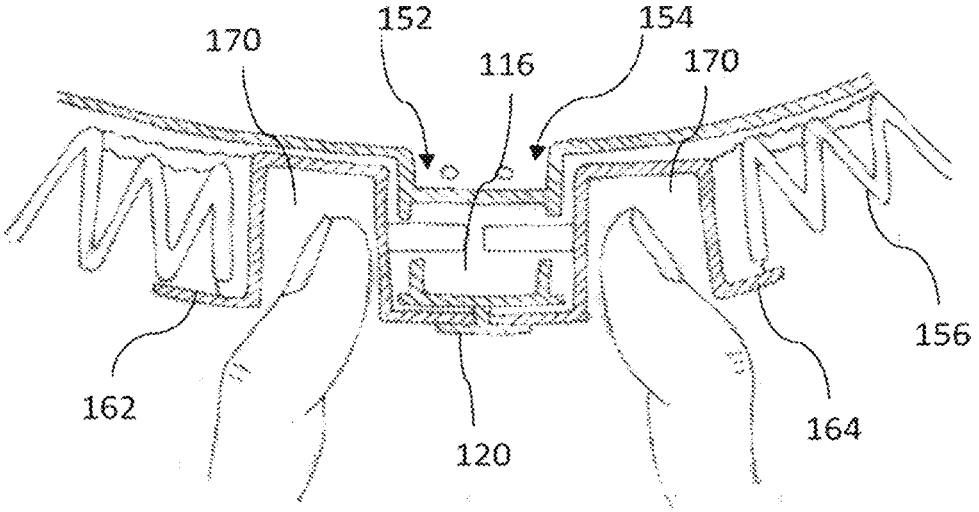
FIG. 11 is a sectional top view of the release mechanism of FIG. 10.

FIGS. 10 and 11 show an alternative embodiment in which first and second retention assembly 112, 114 and a first and second engagement element 152, 154 are in an engaged position. All features of this embodiment other than those described below are the same as the embodiment shown in FIGS. 1 to 9. In this embodiment, the apertures 118 extend through sidewalls of the longitudinal channel 116 in a tangential direction to receive the respective engagement elements 154, 152 in a tangential direction of the fan body 100 such that the edges 158, 160 of the filter media 156 are pushed by a user in the tangential direction of the fan body 100 to engage the engagement elements 152, 154 with the retention assemblies 112, 114.

In this embodiment, the rigid mouldings 162, 164 comprise an outward-facing recess 170 for receiving a user's finger, thus allowing the user to apply a tangential force without deforming the filter media 156. The rigid mouldings 162, 164 extend along the length of the respective edge of the filter media 156.

In this embodiment, the fan body 100 comprises a release switch 120 actuable by a user to release the first and second engagement elements 152, 154 from the respective first and second retention assemblies 112, 114. The release switch 120 is positioned on the longitudinal channel 116 for easy and intuitive use by a user.

Other embodiments of the invention are envisaged which fall within the scope of the invention. For example, an embodiment in which the further filter assembly 150 is releasably engaged with the filter assembly 200 rather than the fan body 100, or in which two or more filter assemblies 150 are employed to surround the fan body 100.

The invention claimed is:

1. A fan assembly comprising:

a fan body comprising first and second retention assemblies and an inlet surface defining an air inlet;

a motor-driven impeller contained within the fan body and arranged to generate an airflow; and a filter assembly attached to the fan body, the filter assembly comprising one or more flexible filter media, a first engagement element positioned at first edge of the filter media, and a second engagement element positioned at a second, opposite edge of the filter media, wherein the filter assembly is furlable, and the first and second engagement elements releasably engage with the respective first and second retention assemblies of the fan body to retain the filter assembly tautly over the inlet surface in an at least partially unfurled state, such that, in use, airflow drawn through the air inlet by the motor-driven impeller is drawn through the filter media, and wherein the first and the second retention assemblies are positioned adjacent to one another, such that the filter assembly extends around substantially all of the fan body from the first retention assembly to the second retention assembly.

2. The fan assembly according to claim 1, wherein the filter assembly does not comprise a frame for supporting the filter media.

3. The fan assembly according to claim 1, wherein the filter assembly comprises two first engagement elements positioned at opposite ends of the first edge of the filter media, and the fan body comprises two first retention assemblies each arranged to receive a respective first engagement element.

4. The fan assembly according to claim 3, wherein the two first retention assemblies are longitudinally aligned in relation to one another with respect to a longitudinal axis of the fan body.

5. The fan assembly of claim 1, wherein the filter assembly comprises two second engagement elements positioned at opposite ends of the second edge of the filter media, and the fan body comprises two second retention assemblies each arranged to receive a respective second engagement element.

6. The fan assembly according to claim 5, wherein the two second retention assemblies are longitudinally aligned in relation to one another with respect to the longitudinal axis of the fan body.

7. The fan assembly according to claim 1, wherein the fan body is substantially cylindrical, and the filter assembly wraps around the fan body.

8. The fan assembly according to claim 7, wherein the filter assembly extends more than 180 degrees around the fan body.

9. The fan assembly according to claim 8, wherein the filter assembly substantially surrounds the fan body.

10. The fan assembly according to claim 1, wherein the first and second retention assemblies comprise respective apertures defined in the fan body, the apertures arranged to receive the respective first and second engagement elements.

11. The fan assembly of claim 1, wherein the filter assembly comprises first and second release tabs each secured to a respective first and second engagement element, and the first and second engagement elements are each arranged to be released from a respective retention assembly upon application of a force to the respective release tab by a user.

12. The fan assembly according to claim 11, wherein the release tabs are formed from a flexible material.

13. The fan assembly according to claim 11, wherein the release tabs are biased towards a tangential direction around the fan body and are movable towards a radial direction by a user to release the respective engagement element from the retention assembly.

14. The fan assembly according to claim 1, wherein the fan body comprises a release switch actuable by a user to release at least one of the first and second engagement elements from the respective first or second retention assembly.

15. The fan assembly according to claim 1, wherein the first and second engagement elements comprise a rigid moulding for receiving the respective edge of the filter media.

16. The fan assembly according to claim 1, wherein the fan body comprises at least one radial flange at an end of the fan body, and wherein the filter assembly abuts the radial flange.

17. The fan assembly according to claim 1, wherein the filter assembly comprises a carbon filter media.

18. The fan assembly according to claim 1, wherein the air inlet comprises an array of apertures formed in the inlet surface and the filter media is arranged to cover the apertures.

19. The fan assembly according to claim 1, comprising a filter housing arranged to removably engage with the fan body and to cover the filter media.

* * * * *